US005386942A

United States Patent [19]

Dietle

[11] Patent Number: 5,386,942

[45] Date of Patent: Feb. 7, 1995

[54] ROOF GUTTER AND DOWNSPOUT CLEANER

[76] Inventor: Carroll E. Dietle, 1860 Coronada Dr., Ann Arbor, Mich. 48103

[21] Appl. No.: 194,349

[22] Filed: Feb. 9, 1994

[51] Int. Cl.[6] ..... B05B 1/14; B05B 12/04

[52] U.S. Cl. ..... 239/532; 239/562; 239/565

[58] Field of Search ..... 239/532, 280, 280.5, 239/281, 562, 565

[56] References Cited

U.S. PATENT DOCUMENTS

| | | | |
|---|---|---|---|
| 2,623,234 | 12/1952 | Brown . | |
| 2,910,711 | 11/1959 | Mizelle | 239/532 X |
| 3,023,971 | 3/1962 | Milhous . | |
| 3,908,910 | 9/1975 | Detwiler | 239/532 X |
| 3,915,382 | 10/1975 | Davis | 239/281 X |
| 3,971,098 | 7/1976 | Davis . | |
| 4,150,793 | 4/1979 | Russo | 239/532 |
| 4,168,559 | 9/1979 | Henson . | |
| 4,303,348 | 12/1981 | O'Brien | 239/532 X |
| 4,349,039 | 9/1982 | Egger | 239/280 X |
| 4,750,883 | 6/1988 | Drake | 239/532 X |
| 4,756,043 | 7/1988 | Hazelet . | |
| 4,925,097 | 5/1990 | Corrigan | 239/562 X |
| 5,022,586 | 6/1991 | Putnam | 239/532 X |
| 5,037,028 | 8/1991 | Evans | 239/532 X |

FOREIGN PATENT DOCUMENTS

| | | | |
|---|---|---|---|
| 839191 | 3/1939 | France | 239/280 |

*Primary Examiner*—Andres Kashnikow
*Assistant Examiner*—Lesley D. Morris
*Attorney, Agent, or Firm*—Harness, Dickey & Pierce

[57] ABSTRACT

A cleaning device having a regulated supply of pressurized fluid which is delivered to an outlet end through one of several interchangeable outlet devices having an outlet flow nozzle for cleaning clogged debris from gutters and downspouts, as well as other elevated structures. Reassembly of interchangeable outlet devices in combination with an outlet end adapter provides for adaptation of the device to optimize cleaning of gutters, and then to optimize cleaning of downspouts. All of the preceding is provided in a device which is quick and easy to assemble, and can be taken apart for storage, without wrenches.

6 Claims, 1 Drawing Sheet

ROOF GUTTER AND DOWNSPOUT CLEANER

FIELD OF THE INVENTION

This invention relates to a device for hydraulic jet cleaning of elevated and extended positions on a building or structure and more particularly to a roof gutter and downspout cleaner having interchangeable end fittings for adapting the device to clean hard to reach locations with a strong spray of water.

BACKGROUND OF THE INVENTION

Collection of roofing debris, leaves, and twigs in gutters and downspouts is a commonly recognized problem requiring frequent cleaning and dislodgement of items which restrict water flow through a gutter and downspout system. Various devices have been employed to facilitate cleaning of gutters and downspouts without a ladder which generally comprise an extended handle having a turned end for ejecting water or fluid into a clogged area to relieve and dislodge particles. However, none provide a cleaning device with easily interchangeable end attachments having comparable flow regulating outlets forming water discharge ends which direct water under pressure at a desired angle relative to the object being cleaned, for example a gutter or downspout.

SUMMARY OF THE INVENTION

A cleaning device of this invention has a generally elongated tubular body, a reverse bend at an outlet end, and a flow regulating outlet device for emitting a pressurized spray of cleaning fluid or water. To facilitate angular positioning of interchangeable outlet devices, a garden hose splitter connector can be inserted between the outlet end and outlet device. A flow control valve is provided at a body inlet for regulating fluid flow and the outlet end forms a coupling for mating with outlet devices.

In a first assembled embodiment of the invention, a flow regulating garden hose nozzle is mated in sealed engagement with a tubular body outlet end to form an outlet device with a flexible hose portion having a flow nozzle at the distal end. The resulting outlet device can be easily inserted within a down spout to more strategically deliver pressurized water at lodged particles within the downspout. Alternatively, the outlet device can be sealingly connected to a hose splitter connector at one of its outlet ends, with the splitter inlet end being sealingly connected to the tubular body outlet end. By capping off, or valve closing the splitters other outlet end, the outlet device can be presented into a gutter at a desired angle to deliver pressurized fluid flow to clean the gutter. By reversing attachment to the other splitter outlet end, the nozzle angular orientation can be biased in a reverse direction. The device can then be positioned and moved within a gutter to deliver high pressure water flow from the nozzle which displaces debris where it is eventually delivered to the downspout and dislodged.

Objects, features and advantages of this invention are to provide an adaptable outlet end cleaning device having a variety of interchangeable flow regulating outlet devices with nozzles which can be carried in a preferred orientation on the devices outlet end. The device is constructed from an elongated tubular body with a reverse bend outlet end which delivers water from an inlet end through a flow control valve to provide pressurized water at the flow nozzle for cleaning structures such as gutters and downspouts. The resulting device provides the preceding in a strong and lightweight structure which can be designed for compact storage using take apart components, and is simple, stable, rugged, durable, reliable, quick and easy to use and adapt, and is of relatively simple design and economical manufacture.

These and other objects, features and advantages of the invention will become apparent from a consideration of the following description and the appended claims when taken in connection with the accompanying drawings.

DETAILED DESCRIPTION OF THE PREFERRED EMBODIMENT

Figure 1:
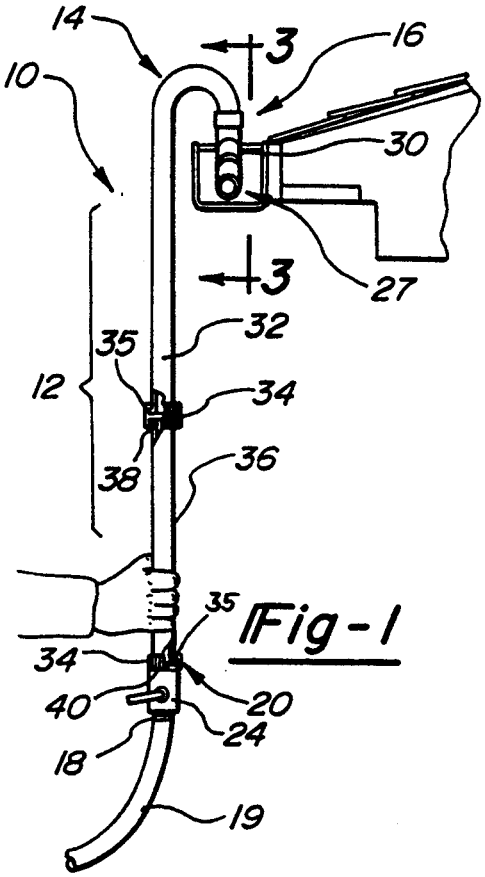
FIG. 1 is a fragmentary sectional view of a house with a gutter being cleaned by the cleaning device embodying this invention.
Figure 3:
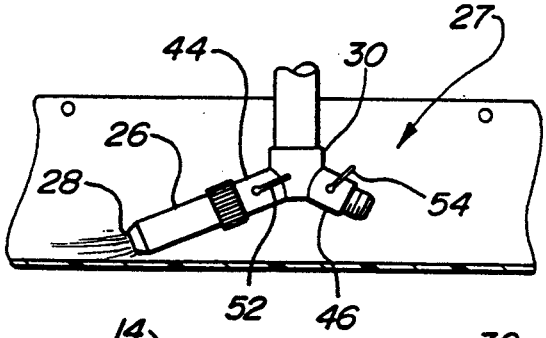
FIG. 3 is a vertical sectional view taken along line 3—3 of FIG. 1.

Referring in more detail to the drawings, FIGS. 1 and 3 illustrate a cleaning device 10 for cleaning gutters and downspouts which embodies this invention. The device has an elongated tubular body 12 with a reverse bend 14 at an outlet end 16 and an inlet coupling 18 formed by a flow control valve 24 which couples to a garden hose 19 adjacent its inlet end 20 for delivering a flow of pressurized water through a flexible hose end attachment 26, or outlet device, at the cleaning device's outlet end. The cleaning device facilitates cleaning of gutters, downspouts, and other elevated surfaces without using a ladder. To position the hose end attachment 26 for cleaning a gutter 27, a hose splitter adapter 30 is connected between attachment 26 and tubular body outlet end 16 which orients the attachment at an angle to the outlet end to produce a lateral flow of fluid from the outlet end of the attachment. Preferably, outlet end 16 has a sealable threaded outlet coupling 22 which complementarily mates with a corresponding complementary coupling 23 on either adapter 30 or attachment 26. Preferably, inlet end 20 also has an end flange 35 supporting a coupling collar 34 which mates and seals with a complementary coupling 40 on flow control valve 24. The other end of valve 24 forms female inlet coupling 18 which threads and seals to the end of a garden hose 19.

As shown in FIG. 1, tubular body 12 is preferably constructed with an upper tube 32 which is sealably and releasably joined to a lower tube 36 to enable disassembly during storage. A female coupling collar 34 is rotatably carried on tube 32 where it is retained by a tube end flange 35, and a male coupling 38 is provided on tube 36 which, when coupled to the collar, seals with the tube end flange. The resulting self sealing joint can be hand tightened without the use of tools. Similarly, inlet end 20 on tube 36 forms another tube end flange 35 which retains a female coupling collar 34. A complementary threaded male coupling 40 on valve 24 is releasably engaged to inlet end 20 where it forms a seal with flange 35. This joint can also be finger tightened by rotatably engaging collar 34 to coupling 40. Preferably, inlet coupling 18, outlet coupling 22, and male and female couplings 34, 38, and 40 are formed from readily commercially available ¾ inch male and female garden hose coupling fittings with self sealing end features. Alternatively, circumferential washers (not shown) should be provided in fittings to produce a water tight seal when assembled.

Figure 2:
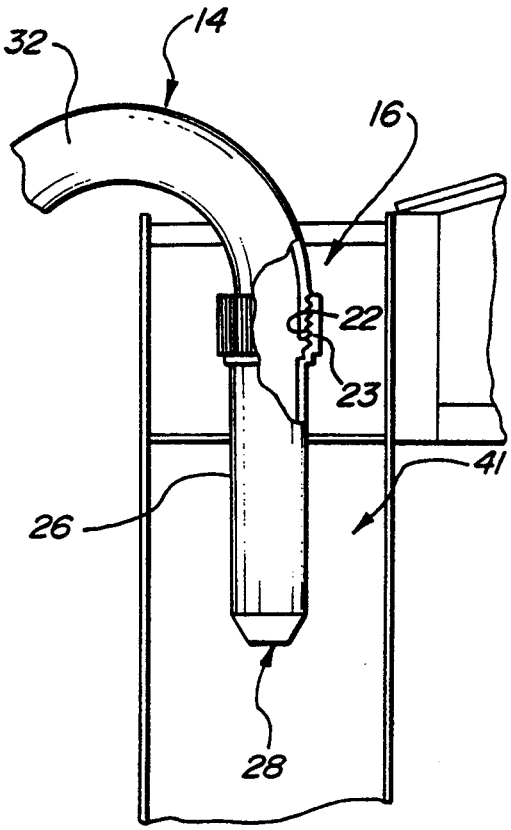
FIG. 2 is an enlarged view of the outlet end of the cleaning device depicted in FIG. 1 showing an alternative outlet device attached to the outlet end and being used to clean a downspout on a house.

FIG. 2 depicts an alternative arrangement for assembling the device in FIGS. 1 and 3 where hose end attachment 26 is directly coupled to outlet end 16 for cleaning downspouts. The reverse bend 14 on device 10 facilitates easy insertion of end attachment 26 into a downspout 41 where high pressure fluid exits restriction 28 to dislodge debris within the downspout.

Figure 4:
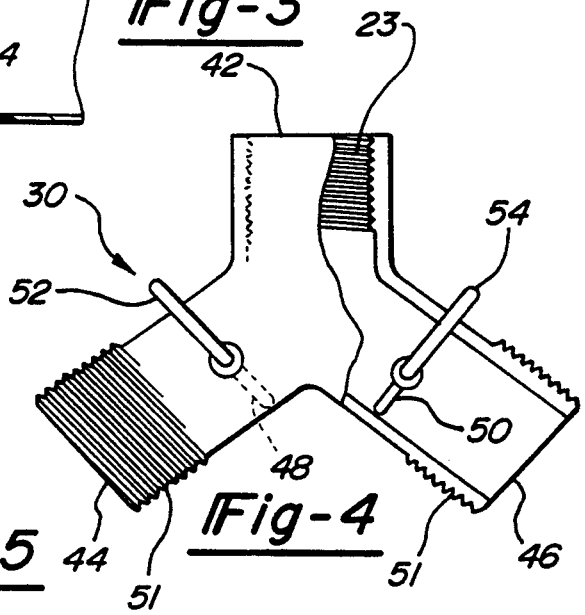
FIG. 4 is a partial sectional view of hose splitter connector as utilized in the FIG. 1 embodiment.

FIG. 4 depicts the splitter adapter 30 of FIG. 1, which has a pair of diverging outlet ends 44 and 46 for regulating flow and an inlet end 42. One of the outlet ends receives attachment 26, in a manner which orients the attachment at a desired angular position to direct the pressurized fluid flow accordingly. A valve 48 and 50 disposed within each outlet end 44 and 46, respectively, for regulating and directing fluid flow to the outlet end carrying an end attachment. Each valve 48 and 50 is controlled from the exterior of the adapter with valve handles 52 and 54, respectively, forming stop cocks. Alternatively, a rigid tubular segment (not shown) with an outlet end angularly biased from an inlet end can be substituted for the adapter.

As shown in FIG. 3 and 4, by turning handle 52 to an open position and handle 54 to a closed position, flow which is received through inlet end 42 leaves through outlet end 44 where it continues to hose end attachment 26 and exits as a pressurized fluid flow for cleaning debris from a gutter. Preferably, the inlet end is provided with female threaded portion 23, comprising a ¾ inch female hose connection which is received on threads 22 of outlet end 16. Likewise, each outlet end forms a ¾ inch standard male threaded hose connection 51. Additionally, the splitter adapter is preferably constructed with molded plastic to minimize corrosion and electrolysis between the tubular body, connector and hose end attachment.

Figure 5:
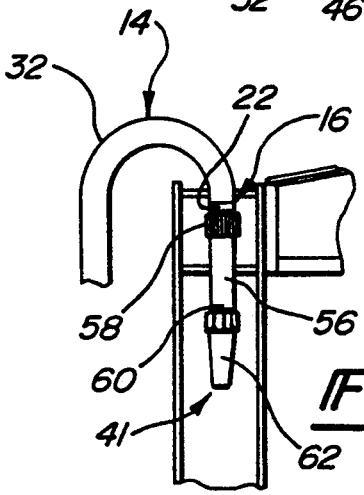
FIG. 5 is an elevational centerline sectional view of an alternative arrangement with a flow regulating outlet device which can be incorporated in either the FIG. 1 or FIG. 2 assembled embodiments.

FIG. 5 depicts an alternative embodiment which uses a flexible hose extender 56 mated to tubular body outlet end 16 in place of the flexible hose end attachment 26 of FIG. 2. One end of the extender has a ¾ inch female hose connection 58 for engaging with outlet coupling 22 and the other end has a ¾ inch male hose connection 60 for coupling to a standard garden hose nozzle 62. Alternatively, extender 56 and nozzle 62 can be used in place of attachment 26 in the FIG. 1 and FIG. 3 embodiment.

As shown in FIGS. 2 and 5, respectively, attachment 26 and flexible hose extender 56 are preferably made of flexibly resistant material such as rubber, plastic, or metal hose. Preferred lengths as shown in the above Figures were arrived at by experimentation. The flexibly resistant material provides for a hydraulic snake, such as a plummer's snake which is a tool of flexible metal of varying lengths as required for the job at hand. It is effective when used to push, prod and penetrate a clog in a pipe by physical up and down and rotative manipulation.

The gutter and downspout cleaning device of this invention is assembled to clean debris in gutters in the FIG. 1 embodiment and is easily re-assembled into the FIG. 2 embodiment for cleaning downspouts. Additionally, the device provides the preceding in an adaptable arrangement which can be taken apart and stored compactly and which is lightweight and of low maintenance to the end user and provides for shut off of high pressure fluid flow into the device, while further providing for interchangeable end attachments to clean various locations, such as cleaning window ledges on buildings, etc.

It is to be understood that the invention is not limited to the exact construction illustrated and described above, but that various changes and modifications may be made without departing from the spirit and scope of the invention as defined in the following claims.

I claim:

1. A cleaning device for cleaning clogged debris from elevated structures, for example gutters and downspouts, comprising an elongated rigid tubular body having a reverse bend at an outlet end and a pressurized fluid supply coupling at an inlet end, said outlet end further providing a body outlet end coupling connector;

a flow control valve provided adjacent said inlet end in fluid communication with said tubular body at a first end and a source of pressurized fluid at a second end, said control valve operable to regulate fluid flow from said source through said tubular body and to said outlet end; and a flow regulating outlet device having a flow nozzle and a releasable coupling connector for mating and demating with said body outlet end coupling connector;

wherein said outlet device is a flexible hose having a distal end releasable coupling connector for sealably engaging with said body outlet end coupling connector and a fluid flow nozzle at a distal end for regulating pressurized fluid flow therethrough.

2. A cleaning device for cleaning clogged debris from elevated structures, for example gutters and downspouts, comprising an elongated rigid tubular body having a reverse bend at an outlet end and a pressurized fluid supply coupling at an inlet end, said outlet end further providing a body outlet end coupling connector;

a flow control valve provided adjacent said inlet end in fluid communication with said tubular body at a first end and a source of pressurized fluid at a second end, said control valve operable to regulate fluid flow from said source through said tubular body and to said outlet end; and a flow regulating outlet device having a flow nozzle and a releasable coupling connector for mating and demating with said body outlet end coupling connector;

wherein said outlet device is a flexible hose having a distal end releasable coupling connector for sealably engaging with said body outlet end coupling connector and a proximal end releasable coupling connector for sealably engaging with a garden hose spray nozzle in order to regulate pressurized fluid flow therethrough.

3. A cleaning device for cleaning clogged debris from elevated structures, for example gutters and downspouts, comprising an elongated rigid tubular body having a reverse bend at an outlet end and a pressurized fluid supply coupling at an inlet end, said outlet end further providing a body outlet end coupling connector;

a flow control valve provided adjacent said inlet end in fluid communication with said tubular body at a first end and a source of pressurized fluid at a second end, said control valve operable to regulate fluid flow from said source through said tubular body and to said outlet end;

a flow regulating outlet device having a flow nozzle and a releasable coupling connector for mating and demating with said body outlet end coupling connector; and an outlet end adapter having an inlet end with a releasable coupling connector for mating with said body outlet end coupling connector and at least one outlet end with a releasable coupling connector for mating with said outlet device coupling connector, said adapter providing pressurized fluid flow from said outlet end to said outlet device:

wherein said outlet end adapter is a flexible hose segment.

4. A cleaning device for cleaning clogged debris from elevated structures, for example gutters and downspouts, comprising an elongated rigid tubular body having a reverse bend at an outlet end and a pressurized fluid supply coupling at an inlet end, said outlet end further providing a body outlet end coupling connector;

a flow control valve provided adjacent said inlet end in fluid communication with said tubular body at a first end and a source of pressurized fluid at a second end, said control valve operable to regulate fluid flow from said source through said tubular body and to said outlet end;

a flow regulating outlet device having a flow nozzle and a releasable coupling connector for mating and demating with said body outlet end coupling connector; and an outlet end adapter having an inlet end with a releasable coupling connector for mating with said body outlet end coupling connector and at least one outlet end with a releasable coupling connector for mating with said outlet device coupling connector, said adapter providing pressurized fluid flow from said outlet end to said outlet device;

wherein said outlet end adapter is a garden hose splitter connector having an inlet end with a releasable coupling connector for receiving said body outlet end coupling connector and a pair of complementary mating outlet ends each with a releasable coupling connector for coupling with said outlet device coupling connector, at least one outlet end engagably receiving one of said outlet devices, and having a stop cock disposed within each outlet end and rotatable therein to provide selective fluid flow through any of said outlet ends.

5. A cleaning device for cleaning clogged debris from elevated structures, for example gutters and downspouts, comprising:

an elongated rigid tubular body having a reverse bend at an outlet end and a pressurized fluid supply coupling at an inlet end, said outlet end further providing a body outlet end coupling connector;

a flow control valve provided adjacent said inlet end in fluid communication with said tubular body at a first end and a source of pressurized fluid at a second end, said control valve operable to regulate fluid flow from said source through said tubular body and to said outlet end;

a flow regulating outlet device having a flow nozzle and a releasable coupling connector for mating and demating with said body outlet end coupling connector; and an outlet end adapter having an inlet end with a releasable coupling connector for mating with said body outlet end coupling connector and at least one outlet end with a releasable coupling connector for mating with said outlet device coupling connector, said adapter providing pressurized fluid flow from said outlet end to said outlet device;

wherein said outlet device is a flexible hose having a distal end releasable coupling connector for mating with one of said outlet end adapter coupling connectors and a fluid flow nozzle at a distal end for regulating pressurized fluid flow therethrough.

6. A cleaning device for cleaning clogged debris from elevated structures, for example gutters and downspouts, comprising an elongated rigid tubular body having a reverse bend at an outlet end and a pressurized fluid supply coupling at an inlet end, said outlet end further providing a body outlet end coupling connector;

a flow control valve provided adjacent said inlet end in fluid communication with said tubular body at a first end and a source of pressurized fluid at a second end, said control valve operable to regulate fluid flow from said source through said tubular body and to said outlet end;

a flow regulating outlet device having a flow nozzle and a releasable coupling connector for mating and demating with said body outlet end coupling connector; and an outlet end adapter having an inlet end with a releasable coupling connector for mating with said body outlet end coupling connector and at least one outlet end with a releasable coupling connector for mating with said outlet device coupling connector, said adapter providing pressurized fluid flow from said outlet end to said outlet device;

wherein said outlet device is a flexible hose having a distal end releasable coupling connector for mating with one of said outlet end adapter coupling connectors and a proximal end releasable coupling connector for sealably engaging with a garden hose spray nozzle in order to regulate pressurized fluid flow therethrough.

* * * * *